US012760991B2

(12) United States Patent
Marlow

(10) Patent No.: US 12,760,991 B2
(45) Date of Patent: Oct. 13, 2026

(54) SYSTEM AND METHOD OF ADDING AND REMOVING ROLL PINS FROM A FIREARM

(71) Applicant: Jason Marlow, Newton Grove, NC (US)

(72) Inventor: Jason Marlow, Newton Grove, NC (US)

( * ) Notice: Subject to any disclaimer, the term of this patent is extended or adjusted under 35 U.S.C. 154(b) by 462 days.

(21) Appl. No.: 18/403,835

(22) Filed: Jan. 4, 2024

(65) Prior Publication Data

US 2025/0224200 A1 Jul. 10, 2025

(51) Int. Cl.
*F41C 27/00* (2006.01)

(52) U.S. Cl.
CPC ..... *F41C 27/00* (2013.01)

(58) Field of Classification Search
CPC ..... F41A 11/00
USPC ..... 42/108, 90, 106
See application file for complete search history.

(56) References Cited

U.S. PATENT DOCUMENTS

| | | | | |
|---|---|---|---|---|
| 4,837,963 | A * | 6/1989 | Slappey, Jr. | B25B 27/02 81/3.05 |
| 6,230,430 | B1 * | 5/2001 | Gosselin | F41C 27/00 42/90 |
| 2005/0115041 | A1 * | 6/2005 | Tilley | B25B 27/04 29/275 |
| 2006/0168870 | A1 * | 8/2006 | Haponski | F41A 35/00 42/108 |
| 2008/0190006 | A1 * | 8/2008 | Jenkins | B25B 27/04 42/90 |

* cited by examiner

*Primary Examiner* — Reginald S Tillman, Jr.
(74) *Attorney, Agent, or Firm* — Ashley D. Johnson; Dogwood Patent and Trademark Law

(57) ABSTRACT

A system and method for adding and removing a roll pin from a firearm. The system comprises an upper plate defined by a top surface and an opposed bottom surface. The bottom surface comprises at least one punch insert sized and shaped to remove a roll pin from a corresponding bore hole in a firearm. The bottom surface also includes at least one punch pin configured to releasably hold a first end of a roll pin. The system also includes a lower plate defined by a top surface and a bottom surface, wherein the top surface includes a channel that passes through the lower plate.

17 Claims, 10 Drawing Sheets

SYSTEM AND METHOD OF ADDING AND REMOVING ROLL PINS FROM A FIREARM

TECHNICAL FIELD

The presently disclosed subject matter relates generally to an improved system and method for adding and removing roll pins from a firearm.

BACKGROUND

Certain automatic and semiautomatic firearms have removable and/or replaceable components (e.g., trigger guards, bolt catch releases) that allow for repair, replacement, and substitution with new or replacement parts. For example, the component typically is held in place by at least one removable and/or resettable roll pin. Roll pins can be inserted/removed in a variety of situations, including the initial firearm assembly, replacement of damaged parts, upgrading of parts, etc. However, the process for removing and adding roll pins from a gun assembly is both time-consuming and complicated. For example, to remove a roll pin, a punch tool is typically placed against an end of the roll pin. The punch tool is then aligned with the long axis of the roll pin so that tapping on the handle end of the punch with a weight or hammer removes and dislodges the roll pin from the gun bore hole in the opposite direction of the applied force. Alternatively, the roll pin may also be pressed (squeezed) into position through the bore hole using a C-clamp, pliers, or the like. As will be appreciated by those of skill in the art, the disassembly or reassembly of the component (e.g., trigger guard, bolt catch release) and allied elements (e.g., the roll pin) is a challenging, tricky, and painstaking activity that often results in damage to the lower receiver. For example, it is difficult to maintain a perfect orientation as pressure and/or tapping of the punch is applied and unnecessary stresses are often applied to the trigger guard and the two trigger guard pin joints, causing damage or breakage. It would therefore be beneficial to provide a device that allows for quick and easy removal of roll pins at component junctions (such as trigger guards and/or bolt catch releases) with improved safety.

SUMMARY

In some embodiments, the presently disclosed subject matter is directed to a system for adding and removing a roll pin from a firearm. Particularly, the system comprises an upper plate defined by a top surface and an opposed bottom surface. The bottom surface comprises at least one punch insert sized and shaped to remove a roll pin from a corresponding bore hole in a firearm. The bottom surface also includes at least one punch pin configured to releasably hold a first end of a roll pin. The system also includes a lower plate defined by a top surface and a bottom surface, wherein the top surface includes a channel that passes through the lower plate. The channel is aligned with the punch insert when the plates are aligned with the upper plate lower face and the lower plate top face in direct contact with each other. The top face of the lower plate includes at least one indentation sized and shaped to house the at least one punch pin when the upper and lower plates are aligned in direct contact with each other. The upper plate and lower plate are parallel and configured to advance towards each other and away from each other on demand.

In some embodiments, the lower surface of the upper plate further includes one or more grooves configured to horizontally and/or vertically house a roll pin.

In some embodiments, the system further includes a pair of pliers with upper and lower parallel jaws that advance towards and away from each other, the upper jaw configured to house the upper plate and the lower jaw configured to house the lower plate.

In some embodiments, the punch insert is partially positioned within a divot configured in the bottom face of the upper plate.

In some embodiments, the punch insert includes a head positioned at a distal end.

In some embodiments, the punch insert includes an angled region positioned directly adjacent to the lower face of the top plate.

In some embodiments, the angled region includes an extending arm extending away from lower face of the top plate.

In some embodiments, the angled region comprises an angle of about 30-60 degrees relative to the lower face of the upper plate.

In some embodiments, the punch insert is positioned adjacent to a first end of the upper plate and the punch pin is positioned adjacent to a second end of the upper plate.

In some embodiments, the lower plate channel is sized and shaped to allow the roll pin to pass therethrough.

In some embodiments, the presently disclosed subject matter is directed to a method of removing a roll pin from a bore hole in a device. Specifically, the method comprises positioning the upper plate of the disclosed system above the roll pin in the device. The method includes positioning the lower plate of the disclosed system below the roll pin in the device, such that that the punch insert, and the channel are aligned vertically with the roll pin. The method includes advancing upper and lower plates towards the device, such that the punch insert enters the bore hole and displaces the roll pin towards the lower plate channel. The roll pin exits the bore hole and enters the channel, thereby removing the roll pin from the device.

In some embodiments, the device is a firearm.

In some embodiments, the device is a trigger guard or bolt catch release of a firearm.

In some embodiments, the upper and lower plates are advanced away from the device after the roll pin has been removed from the bore hole.

In some embodiments, the presently disclosed subject matter is directed to a method of inserting a roll pin into a bore hole of a device. The method includes aligning the upper plate above the bore hole in the device, such that the roll pin is vertically aligned with the bore hole. The method includes aligning the lower plate below the bore hole in the device. The method comprises advancing upper and lower plates towards the device, such that the roll pin enters the bore hole. The method includes removing the upper and lower plates away from the device, such that the roll pin remains within the bore hole of the device.

DETAILED DESCRIPTION

Figure 1A:
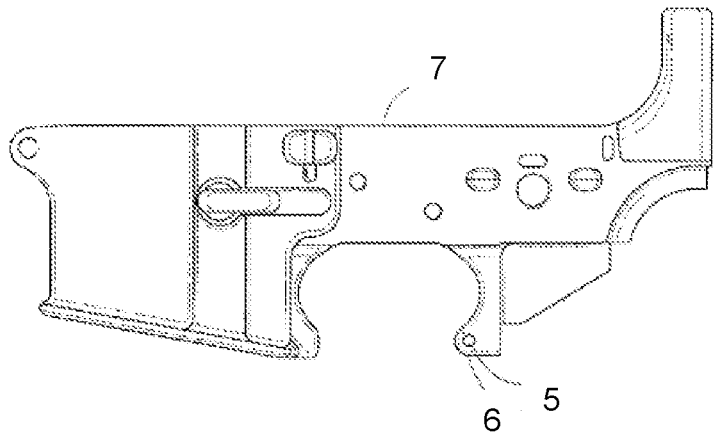
FIG. 1*a* is a fragmentary view of a firearm lower receiver depicting a trigger guard roll pin in accordance with some embodiments of the presently disclosed subject matter.

The presently disclosed subject matter is introduced with sufficient details to provide an understanding of one or more particular embodiments of broader inventive subject matters. The descriptions expound upon and exemplify features of those embodiments without limiting the inventive subject matters to the explicitly described embodiments and features. Considerations in view of these descriptions will likely give rise to additional and similar embodiments and features without departing from the scope of the presently disclosed subject matter.

Unless defined otherwise, all technical and scientific terms used herein have the same meaning as commonly understood to one of ordinary skill in the art to which the presently disclosed subject matter pertains. Although any methods, devices, and materials similar or equivalent to those described herein can be used in the practice or testing of the presently disclosed subject matter, representative methods, devices, and materials are now described.

Following long-standing patent law convention, the terms "a", "an", and "the" refer to "one or more" when used in the subject specification, including the claims. Thus, for example, reference to "a device" can include a plurality of such devices, and so forth. It will be further understood that the terms "comprises," "comprising," "includes," and/or "including" when used herein specify the presence of stated features, integers, steps, operations, elements, and/or components, but do not preclude the presence or addition of one or more other features, integers, steps, operations, elements, components, and/or groups thereof.

Unless otherwise indicated, all numbers expressing quantities of components, conditions, and so forth used in the specification and claims are to be understood as being modified in all instances by the term "about". Accordingly, unless indicated to the contrary, the numerical parameters set forth in the instant specification and attached claims are approximations that can vary depending upon the desired properties sought to be obtained by the presently disclosed subject matter.

As used herein, the term "about", when referring to a value or to an amount of mass, weight, time, volume, concentration, and/or percentage can encompass variations of, in some embodiments +/−20%, in some embodiments +/−10%, in some embodiments +/−5%, in some embodiments +/−1%, in some embodiments +/−0.5%, and in some embodiments +/−0.1%, from the specified amount, as such variations are appropriate in the disclosed packages and methods.

As used herein, the term "and/or" includes any and all combinations of one or more of the associated listed items.

Relative terms such as "below" or "above" or "upper" or "lower" or "horizontal" or "vertical" may be used herein to describe a relationship of one element, layer, or region to another element, layer, or region as illustrated in the drawing figures. It will be understood that these terms and those discussed above are intended to encompass different orientations of the device in addition to the orientation depicted in the drawing figures.

The embodiments set forth below represent the necessary information to enable those skilled in the art to practice the embodiments and illustrate the best mode of practicing the embodiments. Upon reading the following description in light of the accompanying drawing figures, those skilled in the art will understand the concepts of the disclosure and will recognize applications of these concepts not particularly addressed herein. It should be understood that these concepts and applications fall within the scope of the disclosure and the accompanying claims.

Figure 1B:
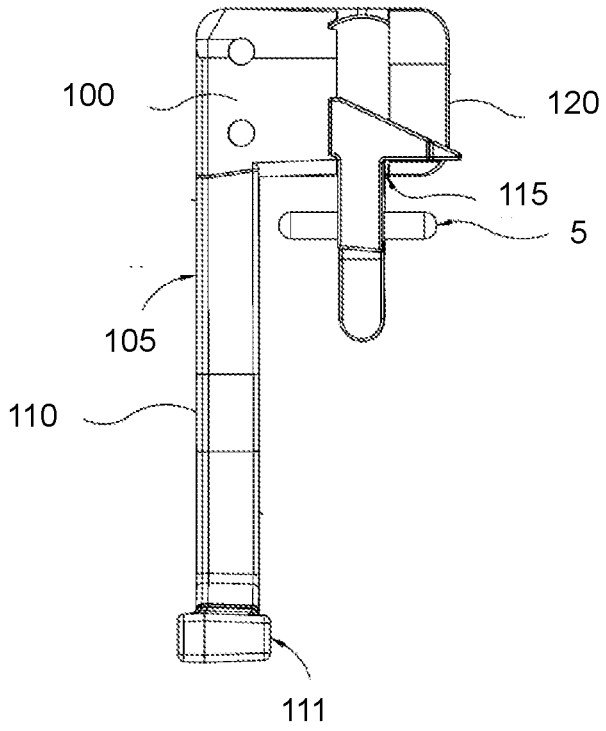
FIG. 1*b* is a fragmentary view of a firearm bolt catch release depicting a roll pin in accordance with some embodiments of the presently disclosed subject matter.

The presently disclosed subject matter is generally directed to a device for the maintenance and repair of firearms. Specifically, the device can be used to assemble and disassemble the trigger guard (or any element) of a firearm by adding and/or removing the weapon roll pin. The term "roll pin" includes and encompasses any type of pin, screw, bolt, cylinder, bearing, roll bearing, roller bearing, or any other comparable or similar structure known to those of skill in the art. Roll pins are conventionally positioned as a component of a weapon trigger guard. FIG. 1*a* illustrates a conventional AR-15/M16 rifle lower receiver 7. As shown, the lower receiver includes roll pin 5 positioned in trigger guard 6. FIG. 1*b* illustrates a conventional bolt catch release used with a firearm. As shown the bolt catch release includes clamp head 100, body 105, first and second legs 110 and 111, opening 115, clamp member 120, and roll pin 5. However, the presently disclosed subject matter is not limited to the specific trigger guard and bolt catch release shown in FIGS. 1*a* and 1*b* and can be used with any roll pin on any type of device (gun or other device).

The term "trigger guard" refers to protective guard on a firearm that surrounds the trigger and defines a space for insertion of a finger to pull the trigger. Please see, for example, U.S. Pat. Nos. 9,121,655; 8,667,725; and 8,434,253, all incorporated by reference herein.

The term "bolt catch release" refers to a component of a firearm that catches the bolt and locks it back after the last round from a magazine is fired, extracted, and ejected. The component can be depressed to release the bolt from a locked position to make the firearm operational. Please see, for example, U.S. Pat. Nos. 9,958,223; 10,151,550; 10,760,863, and 10,113,819, all incorporated by reference herein.

The term "gun" or "firearm" refers to handguns, pistols, rifles, automatic weapons, submachine guns, assault weapons, machine guns, shotguns, and the like. The term can include any of a wide variety of elongated tubes from which projectiles can be thrown by the force of an explosive. In some embodiments, the term refers to weapons that are capable of rapid and continuous fire of projectiles (e.g., bullets).

Figure 2A:
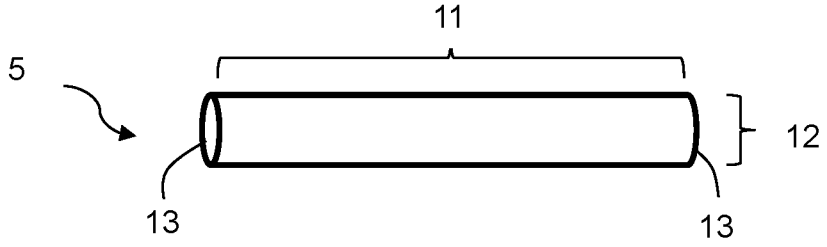
FIG. 2*a* is a perspective view of a cylindrical roll pin in accordance with some embodiments of the presently disclosed subject matter.
Figure 2B:
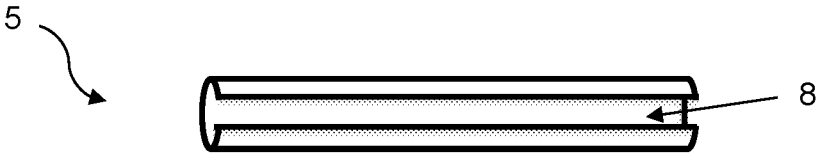
FIG. 2*b* is a perspective view of a cylindrical split roll pin in accordance with some embodiments of the presently disclosed subject matter.
Figure 2C:
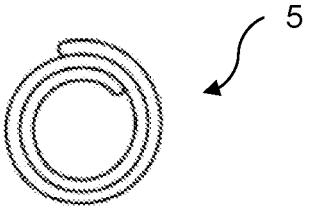
FIG. 2*c* is a cross-sectional view of a coiled roll pin in accordance with some embodiments of the presently disclosed subject matter.

In some embodiments, roll pin 5 can be configured as a hollow, cylindrical pin as shown in FIG. 2*a*. In other embodiments, the roll pin can include lengthwise split 8, as shown in FIG. 2*b*. The pin diameter is oversized relative to the hole it fits into by approximately the gap width of the split. In use, the split roll pin squeezes down as it enters the hole, and the tension secures the pin in place. In some embodiments, the device can be used with a coiled roll pin, as shown in FIG. 2*c*. It should be appreciated that the disclosed device can be used with any type of roll pin and is not limited.

Roll pins are used in firearms because they have the ability to perform while being subjected to heat without stressing the bolt any further. Roll pins are larger in diameter than the bore holes in which they are designed to fit, so when they are initially tapped into position, the pin must compress slightly around its circumference. For example, split roll pins lessen the gap between the butted edges of split 8, while coiled roll pins must tighten the coil overlap to squeeze into the bore hole.

It should be appreciated that the size and shape of roll pin 5 is not limited. For instance, the roll pin can be configured with any suitable length or circumference. Suitable roll pins can therefore include length 11 of about 0.1-5 inches (e.g., at least/no more than about 0.1, 0.5, 1, 2, 3, 4, or 5 inches). The roll pin "length" is the longest horizontal distance of the roll pin, such as the length between ends 13. Roll pin 5 can further include width 12 of about 0.01-1 inch in some embodiments (e.g., at least/no more than about 0.01, 0.05, 0.1, 0.2, 0.3, 0.4, 0.5, 0.6, 0.7, 0.8, 0.9, or 1 inch). The roll pin "width" is the longest vertical distance of the roll pin, or the dimension perpendicular to the length. It should be appreciated that the dimensions of roll pin 5 can vary widely depending on the size/type of weapon. The dimensions are therefore not limited and can be configured outside the ranges given above.

Further, the roll pin can be constructed from any suitable material, such as metal (e.g., steel, stainless steel, copper, aluminum), carbon fiber, wood, plastic, and the like.

Figure 3:
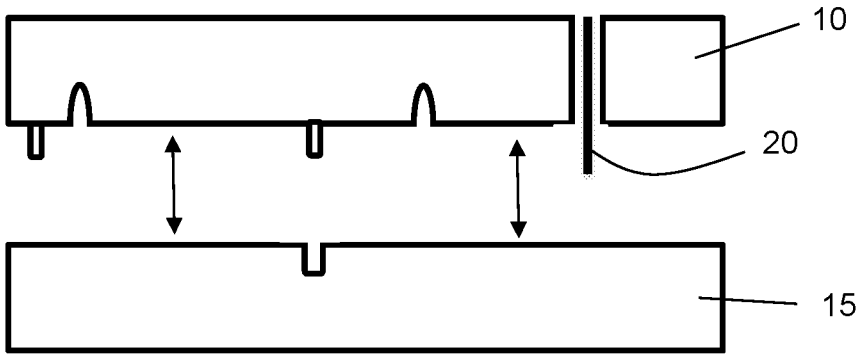
FIG. 3 is a side plan of device upper and lower plates in accordance with some embodiments of the presently disclosed subject matter.

The presently disclosed system includes upper and lower plates that can be attached to pliers (or any other tool) to remove or install a roll pin from a gun. Any fastener can be used to releasably or permanently attach the plates to the pliers, such as (but not limited to) the use of adhesive, welding, thermoforming, magnets, screws, bolts, staples, and the like. FIG. 3 illustrates one embodiment of upper and lower plates 10, 15 that are positioned approximately parallel relative to each other. The term "plate" broadly refers to any planar or substantially planar support. As shown, the plates include a series of pins, grooves, and at least one punch insert 20, as discussed in detail below.

Figure 4:
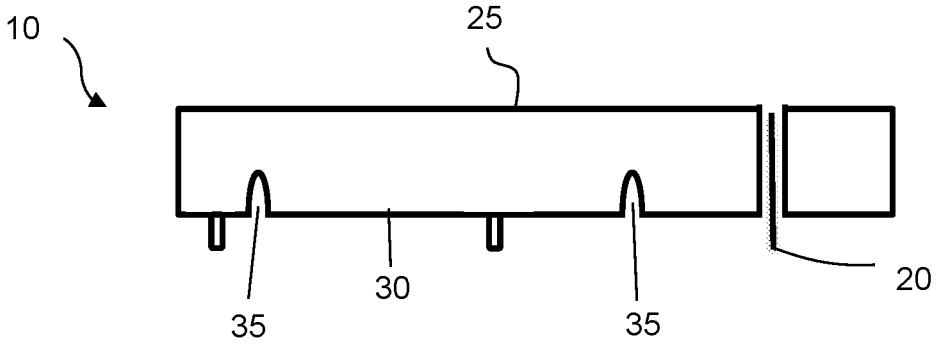
FIG. 4 is a side plan view of an upper plate in accordance with some embodiments of the presently disclosed subject matter.

FIG. 4*a* depicts one embodiment of upper plate 10 that attaches to the upper jaw of a pair of pliers. As shown, the upper plate includes top face 25 that is in direct contact the upper jaw of a pair of pliers. The upper plate also includes opposed bottom face 30 that is adjacent to and faces bottom plate 15. The bottom face includes one or more grooves 35. The term "groove" refers to any type of indentation in a surface that extends inward. Each groove 35 is configured to hold a roll pin that is to be added to a gun or to hold a roll pin that has been removed from a gun (e.g., to ensure that the roll pin does not get lost).

The roll pin is then secured in place on the bottom surface of upper plate 10. When a user desires to remove the roll pin from groove 35, they can easily dislodge the roll pin using light pressure and a pulling action.

Upper plate 10 can include any number of grooves 35, such as about 1-5 or more (e.g., at least/no more than about 1, 2, 3, 4, 5). In some embodiments, each groove is configured in about the same size and/or shape. In other embodiments, the upper plate can include grooves of varying size and/or shape to accommodate different roll pin sizes/shapes.

Figure 5A:
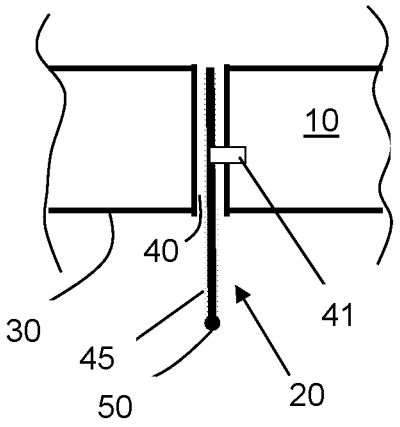
FIG. 5*a* is a fragmentary side plan view of an upper plate comprising a punch insert in accordance with some embodiments of the presently disclosed subject matter.

Bottom surface 30 of the top plate further includes punch insert 20 as noted above. The term "punch" refers to a tool used to drive a roll pin or from a corresponding bore hole in a gun. FIG. 5*a* illustrates one embodiment of the punch insert housed within divot 40. The punch insert can be releasably positioned within the divot using any suitable mechanism, such as (but not limited to) the use of one or more set screws 41.

The punch insert can be configured to include a cylindrical or tubular body 45 with optional head 50 formed on the distal end. The size of the body and/or head are such that they can fit into the weapon bore hole to offset and then push out (remove) a roll pin.

Figure 5B:
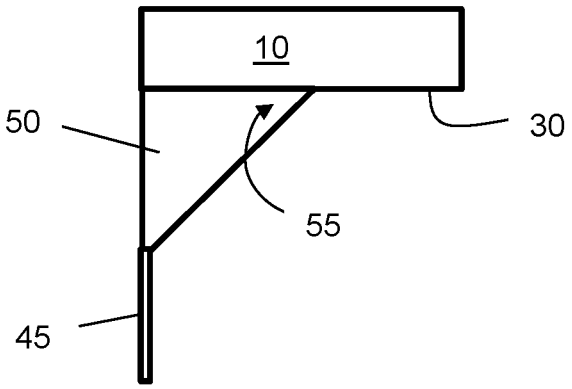
FIG. 5*b* is a side plan view of a punch insert in accordance with some embodiments of the presently disclosed subject matter.

In some embodiments, a portion of base 45 is angled to improve stability during use, as shown in FIG. 5*b*. The angled region therefore resists bending and breaking of any portion of the punch insert. The angled region can also provide ease of use for the user during removal of a roll pin. Angled region 50 can be configured at any desired angle 55 relative to the bottom face of the upper plate, such as about 5-85 degrees (e.g., at least/no more than about 5, 10, 15, 20, 25, 30, 35, 40, 45, 50, 55, 60, 65, 70, 75, 80, or 85 degrees).

Punch insert 20 can be constructed from any type of sufficiently rigid and durable materials known in the art, such as (but not limited to) steel, stainless steel, carbon fiber, aluminum, plastic, and the like. The punch insert body can have a length that is approximately the same as the length of roll pin 5 to effectively displace the pin during use. In other embodiments, the punch insert body has a length that is greater or less than the length of roll pin 5 (e.g., about 5, 10, 15, 20, 25, 30, 35, 40, 45, 50, 55, 60, 65, 70, 75, 80, 85, 90, or 95 percent more/less).

Figure 6A:
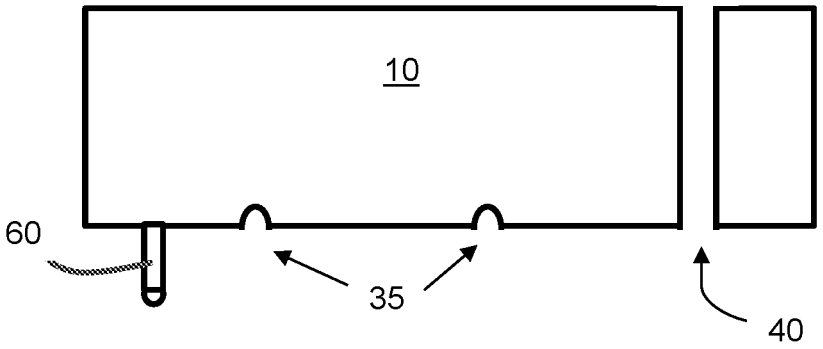
FIG. 6*a* is a cross-sectional view of an upper plate in accordance with some embodiments of the presently disclosed subject matter.

One embodiment of upper plate 10 is shown in FIG. 6*a*. As shown, the bottom face of the upper plate can include one or more grooves 35. Each groove can be semi-circular or can take any shape to allow for cooperation with a corresponding roll pin 5 (such as for storage as noted above). The groove can also cooperate with a roll pin in a vertical orientation in additional to the horizontal (storage) configuration as noted below. The upper plate further includes one or more punch pins 60 positioned to extend vertically (not flush) with the bottom face of the upper plate. Any method can be used to retain the punch pin, such as the use of magnets, clips, fasteners, snap-fit closure, push-fit closure, and the like. For example, in some embodiments, the punch pin can be positioned or removed using light pressure. In some embodiments, upper plate 10 can be manufactured to include a punch pin as shown in FIG. 6*a* (e.g., as an integrated part of the upper plate).

Figure 6B:
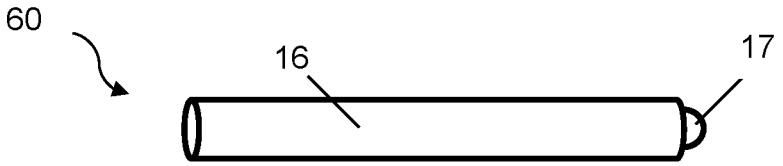
FIG. 6*b* is a perspective view of a punch pin in accordance with some embodiments of the presently disclosed subject matter.

FIG. 6*b* illustrates one embodiment of punch pin 60 including body region 16 and nipple 17 positioned at one end. The term "nipple" refers to any extending region that protrudes from the body region. The nipple can have any suitable shape, such as (but not limited to) semi-circular. The body region can have any shape, such as cylindrical and the like.

Punch pin 60 can have a length (e.g., the distance between the nipple end and opposed body end) of about 5-100 percent of the length of roll pin 5 (e.g., at least/no more than about 5, 10, 15, 20, 25, 30, 35, 40, 45, 50, 55, 60, 65, 70, 75, 80, 85, 90, 95, or 100 percent). For example, if roll pin 5 has a length of 1 inch, the length of the punch pin can be about 0.5 inches (5 percent of the length of the roll pin) to about 1 inch (100 percent of the length of the roll pin). Thus, the punch pin can include length of about 0.001-1 inch (e.g., at least/no more than about 0.001, 0.005, 0.01, 0.02, 0.03, 0.04, 0.05, 0.06, 0.07, 0.08, 0.09, 0.1, 0.2, 0.3, 0.4, 0.5, 0.6, 0.7, 0.8, 0.9, or 1 inch).

Figure 6C:
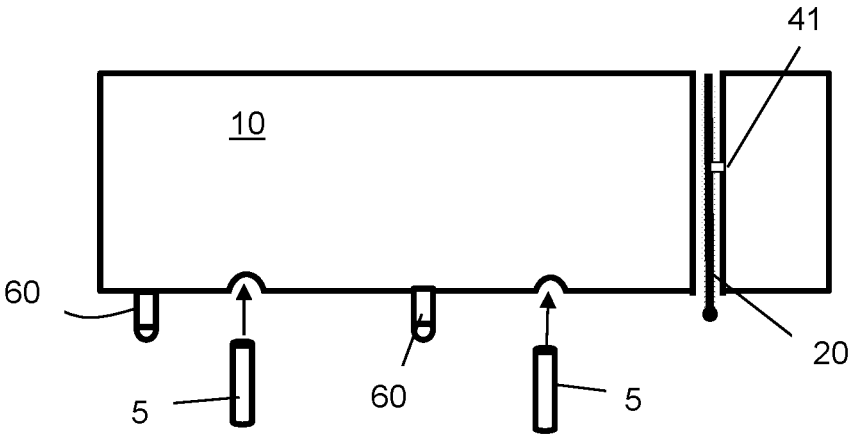
FIGS. 6*c* and 6*d* illustrate cross-sectional views of roll pins inserted into grooves in accordance with some embodiments of the presently disclosed subject matter.
Figure 6D:
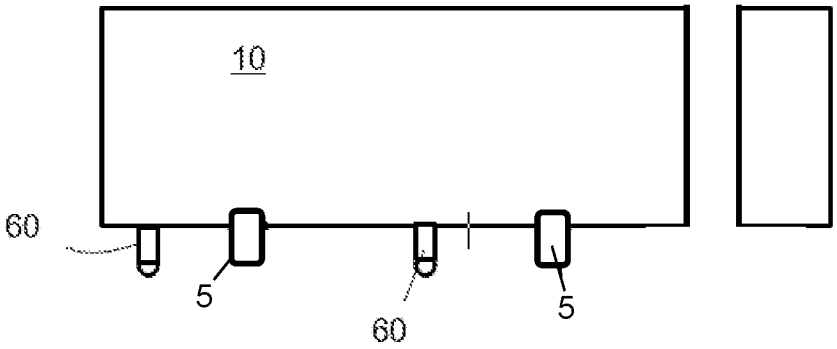
Figure 6E:
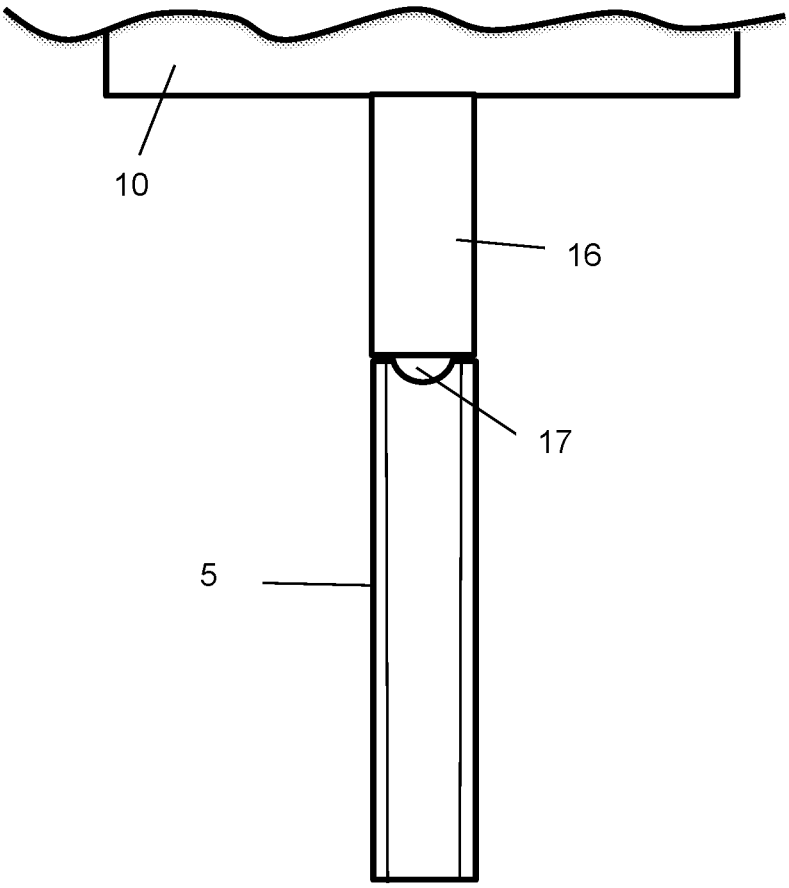
FIG. 6*e* is a cross-sectional view of a punch pin and roll pin in accordance with some embodiments of the presently disclosed subject matter.

In use, roll pins 5 are releasably positioned in each groove 35 in a vertical orientation (e.g., up and down) as shown in FIGS. 6*c* and 6*d*. In use, a roll pin is removed from groove 35 using any mechanism. For example, pressure can be applied to the gun borehole with roll pin 5 still recessed in a corresponding groove. The collapsing action of roll pin 5 going into the borehole will then release it from groove 35. Each roll pin can then cooperate with punch pin 60, as shown in FIG. 6*e*. Specifically, while roll pin 5 is inserted in the gun borehole, punch pin 60 will set the push pin flush to the rim of the borehole. Specifically, nipple 17 is sized and shaped to fit within the interior of the push pin at one end, therefore allowing the push pin to be set in proper position, The upper plate can include any number of punch pins, such as about 1-5 or more (e.g., 1, 2, 3, 4, or 5).

Punch pin 60 can be constructed from any suitable material, such as (but not limited to) metal, plastic, wood, composite material, or combinations thereof.

Figure 7:
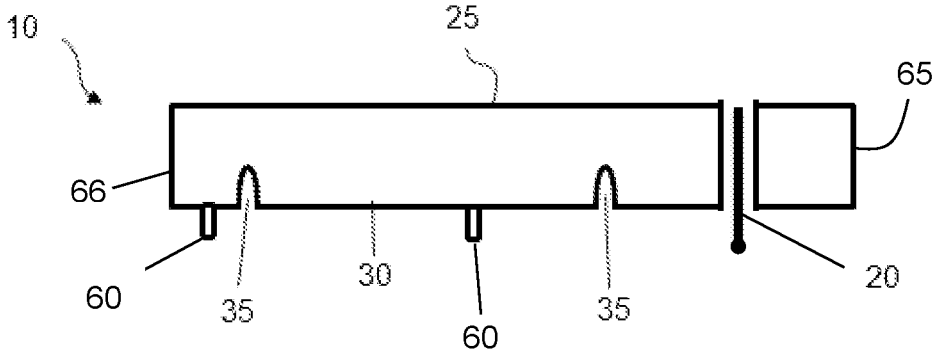
FIG. 7 is a side plan view of an upper plate in accordance with some embodiments of the presently disclosed subject matter.

The grooves, punch pin, and punch insert can be arranged in various configurations on the bottom face of upper plate 10. For example, the punch insert can be positioned at or adjacent to a first end 65 of the plate. In this orientation, the punch insert aligns with a corresponding channel or opening on the lower plate as discussed below. Punch pin 60 can be positioned at any location, such as adjacent to second end 66 and/or adjacent to the punch insert, as shown in FIG. 7. Holes 35 can likewise be positioned at any location, such as (but not limited to) between adjacent grooves and/or between a groove and the punch insert. Such an arrangement allows for proper alignment with the lower plate, as well as optimal use of the plate components to remove or add a roll pin. However, the position of the various elements of the upper and lower plates are not limited.

Figure 8A:
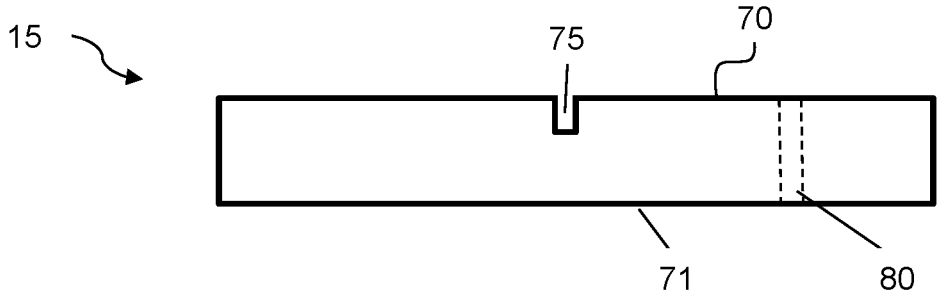
FIG. 8*a* is a side plan view of a lower plate in accordance with some embodiments of the presently disclosed subject matter.
Figure 8B:
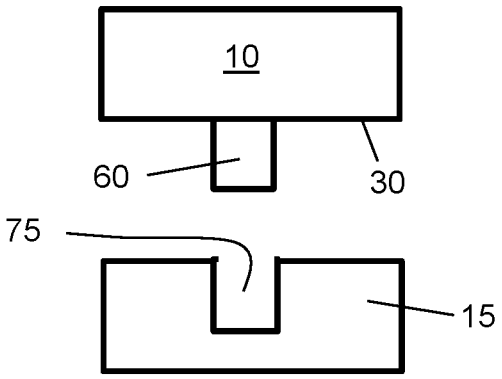
FIGS. 8*b* and 8*c* are side plan views of a lower plate indentation housing a push pin in accordance with some embodiments of the presently disclosed subject matter.
Figure 8C:
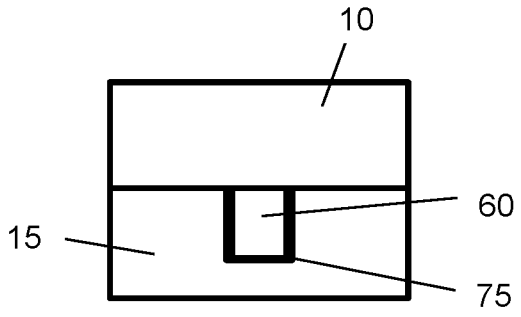

As described above, the presently disclosed subject matter also includes bottom plate 15 that cooperates with top plate 10 to add or remove a roll pin. As shown in FIG. 8*a*, each bottom plate includes top face 70 (that faces the bottom face of the top plate) and opposed lower face 75 that cooperates with the lower jaw of a pair of pliers. The top face of the bottom plate includes one or more indentations 75 that are sized and shaped to house push pin 60 when the top and bottom plates are advanced together, as shown in FIGS. 8*b* and 8*c*. Thus, each indentation 75 is aligned with and sized/shaped to accommodate a corresponding push pin 60 on the top plate.

Figure 9A:
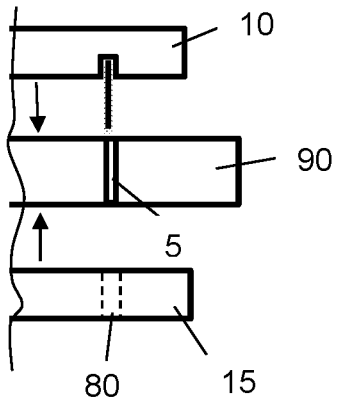
FIGS. 9*a*-9*c* are cross-sectional views of a roll pin insertion into a gun bore hole in accordance with some embodiments of the presently disclosed subject matter.
Figure 9B:
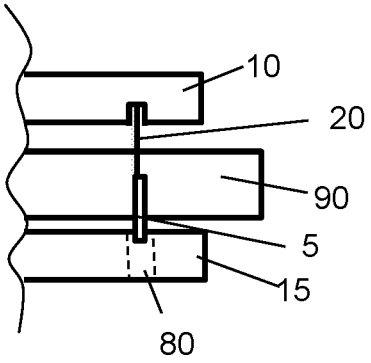
Figure 9C:
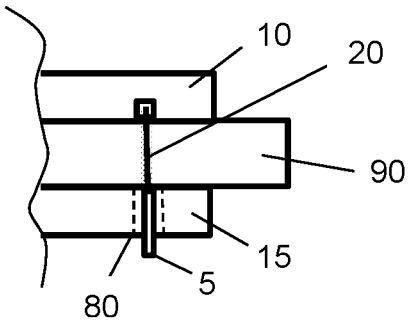

Top face 70 of the lower plate further includes channel 80 aligned with the punch insert, functioning as a passageway for a corresponding roll pin to pass therethrough when being removed from a gun bore hole. Thus, as the upper and lower plates are advanced together, the punch insert dislodges the roll pin from gun 90 bore hole, and the roll pin exits the bore hole and passes through channel 80 until it fully exits the gun. One embodiment of the roll pin entering, passing through, and exiting the lower plate channel is illustrated in FIGS. 9*a*-9*c*. Channel 80 therefore is configured to receive a roll pin when ejected from a gun bore (e.g., a trigger guard). The channel includes a depth that can substantially or fully receive roll pin 5. The roll pin can then be fully ejected from the lower plate or extending from the lower face of the lower plate to enable retrieval with a pair of tweezer or other suitable tools. Once the roll pin exits the gun bore hole, the upper and lower plates can be advanced away from the gun.

Channel 80 has dimensions that are slightly larger than the dimensions of the roll pin (e.g., in length and/or width). For example, the channel clearance can be about 0.001 to 0.01 inches in some embodiments.

Figure 10:
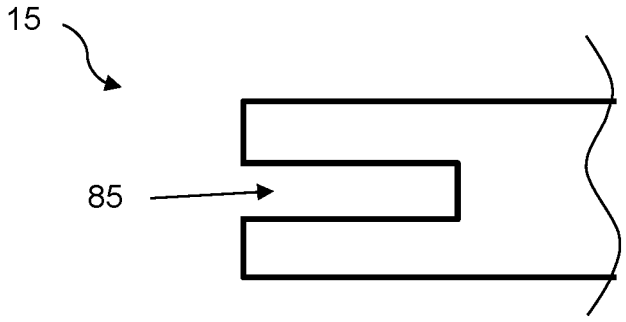
FIG. 10 is a partial top plan view of a bottom plate in accordance with some embodiments of the presently disclosed subject matter.

FIG. 10 illustrates a top view of bottom plate 15, depicting channel 80 and notch 85. The notch accommodates the angled region of the punch insert during use. Stated another way, the notch allows the punch insert of the upper plate to push the roll pin out of a bore hole. Without the notch, the lower plate would block progression of the punch insert. The notch passes all the way through the bottom plate.

Figure 11A:
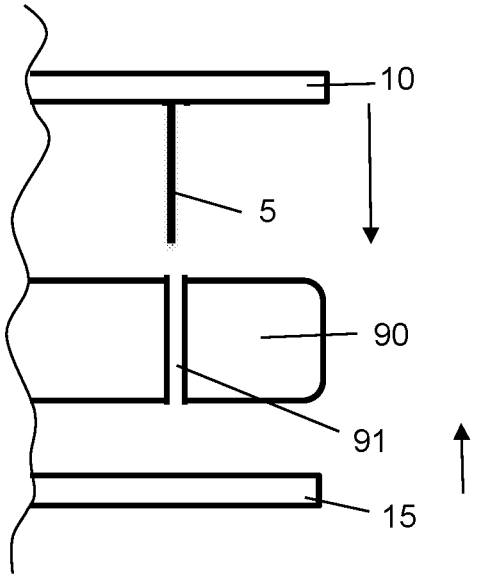
FIGS. 11*a*-11*c* are cross-sectional views of a roll pin insertion into a gun bore hole in accordance with some embodiments of the presently disclosed subject matter.
Figure 11B:
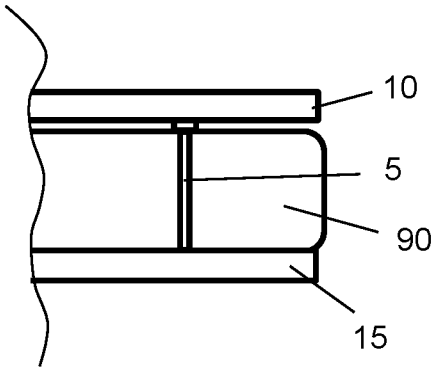
Figure 11C:
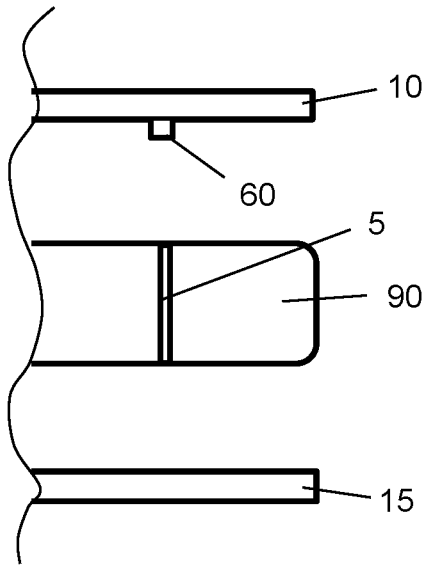

To insert a roll pin to re-secure the trigger guard lever in proper position within a gun, a roll pin can be accessed from one or more grooves 35 of the upper plate using a slight pulling action. Alternatively, a roll pin may be grasped from a larger supply of roll pins. The top and bottom plates 10, 15 can be positioned on either side of a gun trigger guard and aligned such that the roll pin is directly in line with the trigger guard bore hole 91. The upper and lower plates are then advanced together, such that the roll pin is fully positioned within the gun bore hole, as shown in FIG. 11*b*. The upper and lower plates are then removed from the gun, and the roll pin remains secured within the trigger guard, as shown in FIG. 11*c*.

Figure 12:
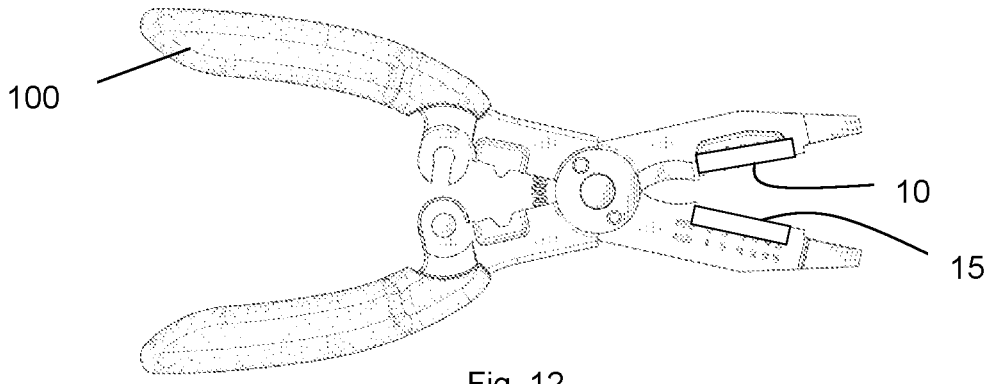
FIG. 12 is a top plan view of a pair of pliers comprising upper and lower plates in accordance with some embodiments of the presently disclosed subject matter.

The upper and lower plates can be positioned on a standard pair of pliers or on any device with upper and lower jaws that advance towards and away from each other. One representative pair of pliers 100 is illustrated in FIG. 12. However, it should be appreciated that the pliers are not limited, and any tool can be used. The term "pliers" refers to any type of hand toll used to hold objects firmly. Thus, the term can include any hand tool having two hinged arms and a pair of pivoted, opposing jaw members used for holding, bending, and/or cutting.

The disclosed system is generally used by an armorer, gunsmith, repair or assembly technician, maintenance personnel, and the like. However, a home (non-commercial) user may find the device to be a useful aid as well.

Although device 10 has been discussed herein for use with the roll pins of a gun, it should be appreciated that the device is not limited and can be used on any element that includes a roll pin.

The disclosed device includes many advantages over prior art methods and tools for adding and removing a roll pin from a firearm. For example, the disclosed device allows for the simple and rapid insertion/removal of a roll pin by advancing the upper and lower jaws of a pair of pliers together. The system contrasts sharply with the time consuming method of using a vice, tapping a punch into the bore hole, etc.

The disclosed device is simple and easy to use, such that even gun novices can effectively add and remove a roll pin.

The disclosed device reduces the incidence of damage to the corresponding gun (e.g., trigger guard) since there is no hammering action with a punch.

The disclosed device is durable and can be used for many years without replacement.

Advantageously, the device allows for the storage of roll pins so that they are not lost.

As described above, although preferred embodiments of the present invention have been described for illustrative purposes, those skilled in the art will appreciate that various modifications, additions and substitutions are possible, without departing from the scope and spirit of the invention as disclosed in the accompanying claims.

What is claimed is:

1. A system for adding and removing a roll pin from a firearm, the system comprising:

an upper plate defined by a top surface and an opposed bottom surface, wherein the bottom surface comprises at least one punch insert sized and shaped to remove a roll pin from a corresponding bore hole in a firearm and wherein the bottom surface also includes at least one punch pin configured to releasably hold a first end of a roll pin;

a lower plate defined by a top surface and a bottom surface, wherein the top surface includes a channel that passes through the lower plate, wherein the channel is aligned with the punch insert when the plates are aligned with the upper plate lower face and the lower plate top face in direct contact with each other;

wherein the top face of the lower plate includes at least one indentation sized and shaped to house the at least one punch pin when the upper and lower plates are aligned in direct contact with each other; and wherein upper plate and lower plate are parallel and configured to advance towards each other and away from each other on demand.

2. The system of claim 1, wherein the lower surface of the upper plate further includes one or more grooves configured to vertically house a roll pin.

3. The system of claim 1, further comprising a pair of pliers with upper and lower parallel jaws that advance towards and away from each other, the upper jaw configured to house the upper plate and the lower jaw configured to house the lower plate.

4. The system of claim 1, wherein the punch insert is partially positioned within a divot configured in the bottom face of the upper plate.

5. The system of claim 1, wherein the punch insert includes a head positioned at a distal end.

6. The system of claim 1, wherein the punch insert includes an angled region positioned directly adjacent to the lower face of the top plate.

7. The system of claim 6, wherein the angled region includes an extending arm extending away from lower face of the top plate.

8. The system of claim 6, wherein the angled region comprises an angle of about 30-60 degrees relative to the lower face of the upper plate.

9. The system of claim 1, wherein the punch insert is positioned adjacent to a first end of the upper plate and the punch pin is positioned adjacent to a second end of the upper plate.

10. The system of claim 1, wherein the lower plate channel is sized and shaped to allow the roll pin to pass therethrough.

11. A method of removing a roll pin from a bore hole in a device the method comprising:

positioning the upper plate of the system of claim 1 above the roll pin in the device;

positioning the lower plate of the disclosed system below the roll pin in the device, such that that the punch insert and the channel are aligned vertically with the roll pin;

advancing upper and lower plates towards the device, such that the punch insert enters the bore hole and displaces the roll pin towards the lower plate channel;

wherein the roll pin exits the bore hole and enters the channel, thereby removing the roll pin from the device.

12. The method of claim 11, wherein the device is a firearm.

13. The method of claim 11, wherein the device is a trigger guard or bolt catch release of a firearm.

14. The method of claim 11, wherein the upper and lower plates are advanced away from the device after the roll pin has been removed from the bore hole.

15. A method of inserting a roll pin into a bore hole of a device, the method comprising:

aligning the upper plate of the system of claim 1 above the bore hole in the device, such that the roll pin is vertically aligned with the bore hole;

aligning the lower plate below the bore hole in the device;

advancing upper and lower plates towards the device, such that the roll pin enters the bore hole;

removing the upper and lower plates away from the device, such that the roll pin remains within the bore hole of the device.

16. The method of claim 15, wherein the device is a firearm.

17. The method of claim 15, wherein the device is a trigger guard or bolt catch release of a firearm.

* * * * *